US007124894B1

(12) United States Patent
Dobos

(10) Patent No.: US 7,124,894 B1
(45) Date of Patent: Oct. 24, 2006

(54) DISPOSABLE ORAL CARE DEVICE

(76) Inventor: Steven P. Dobos, 115 Sunny Dr., Pittsburgh, PA (US) 15236

( * ) Notice: Subject to any disclaimer, the term of this patent is extended or adjusted under 35 U.S.C. 154(b) by 416 days.

(21) Appl. No.: 10/782,315

(22) Filed: Feb. 20, 2004

(51) Int. Cl.
*B65D 71/00* (2006.01)

(52) U.S. Cl. ..... 206/581; 206/225; 206/368; 206/63.5; 206/209.1; 206/362.2; 132/309; 132/311

(58) Field of Classification Search ..... 206/63.5, 206/225, 229, 209, 209.1, 361, 362.2, 368, 206/369, 581; 132/308, 309, 311
See application file for complete search history.

(56) References Cited

U.S. PATENT DOCUMENTS

| | | | | |
|---|---|---|---|---|
| 301,055 | A * | 6/1884 | Greene | 132/325 |
| 402,812 | A | 5/1889 | Draper | |
| 3,356,095 | A | 12/1967 | Tylle | |
| 3,690,448 | A * | 9/1972 | Switzer | 206/361 |
| 3,890,986 | A * | 6/1975 | Gerlich | 132/309 |
| 4,530,129 | A | 7/1985 | Labick et al. | |
| 4,821,752 | A * | 4/1989 | Widlak | 132/309 |
| 4,865,481 | A | 9/1989 | Scales | |
| 5,184,719 | A * | 2/1993 | Gordon | 206/209.1 |
| 5,304,009 | A | 4/1994 | Marshall | |
| 5,676,167 | A * | 10/1997 | Garner | 132/309 |
| 5,862,817 | A * | 1/1999 | Lee | 132/311 |
| 5,893,378 | A | 4/1999 | Llerena | |
| 6,105,587 | A * | 8/2000 | Dunn | 132/309 |
| 2003/0019062 | A1 * | 1/2003 | Florence | 15/167.1 |

* cited by examiner

*Primary Examiner*—David T. Fidei

(57) ABSTRACT

A multi-purpose toothbrush for promoting oral hygiene includes an elongated shaft having a brushing section that includes a plurality of bristles extending radially outwardly therefrom. The brushing section is coated with a predetermined quantity of a tooth-cleaning agent that is activatable via water. The shaft further includes an accessory dispensing section integral with a gripping section and oppositely spaced from the brushing section for providing dental floss and mouthwash. A plurality of protective wrappers are removably positioned about the toothbrush for maintaining same in a substantially sanitary condition during non-use conditions.

15 Claims, 4 Drawing Sheets

DISPOSABLE ORAL CARE DEVICE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to an oral care device and, more particularly, to a disposable oral care device.

2. Prior Art

It is well known that a proper care of teeth and mouth hygiene requires the brushing of the teeth after every meal. This rule is of course not practiced by most persons who go to school or to work, so are obliged to neglect such care after a lunch away from home. It is also well known that proper oral hygiene is a necessary component of good health.

However, while most people have ample supplies available at home to maintain proper oral hygiene, they find it inconvenient to transport these items while away from home for short periods. Sometimes, people traveling about forget to pack their toothbrush, floss, or mouthwash. Other times, people find themselves in positions where a dose of oral hygiene could work miracles, but have no means to accomplish this.

Thus, people tend to practice less-than-optimal oral hygiene while at work, in school, or on short trips. It is also well known that without proper dental hygiene, one risks contracting gum disease and a number of tooth ailments relating to oral hygiene.

Prior attempts to remedy this problem have resulted in designs so intricate and complicated that the production cost tended to be more than what one would wish to pay for one of these devices.

Accordingly, a need remains for a disposable oral care device that overcomes the above noted shortcomings.

BRIEF SUMMARY OF THE INVENTION

In view of the foregoing background, it is therefore an object of the present invention to provide a disposable device for oral care. These and other objects, features, and advantages of the invention are provided by a multi-purpose toothbrush for promoting oral hygiene that includes an elongated shaft including a brushing section that has a plurality of bristles extending radially outwardly from the shaft.

The plurality of bristles have a unique size suitable for its intended application, and a predetermined quantity of a tooth-cleaning agent advantageously coated onto the plurality of bristles wherein the agent is activatable via water. Of course, the brushing section can be formed in various shape and sizes ranging from approximately half the size of a conventional toothbrush to twice the size of a conventional toothbrush.

The shaft further includes a gripping section integral with the brushing section and spaced generally medially of the shaft. The gripping section includes top and bottom surfaces extending outwardly from the shaft and has a plurality of grooves formed therein for assisting a user to conveniently maintain a secure grip of the toothbrush.

The shaft further includes an accessory dispensing section integral with the gripping section and oppositely spaced from the brushing section. The accessory dispensing section includes a reservoir that preferably has a generally cylindrical body defining a cavity therein, and a predetermined quantity of mouthwash advantageously disposed within the reservoir. The reservoir includes a detachable bottom end portion for conveniently allowing the mouthwash to be dispensed from the cavity. The bottom end portion includes an elongated shaft portion and a handle portion integral therewith wherein the shaft portion is removable from the cavity when the handle portion is twisted outwardly and away from the reservoir.

The accessory dispensing section may further include a predetermined quantity of dental floss wrapped about the reservoir. The reservoir preferably includes a plurality of spaced lip portions extending radially outwardly therefrom for assisting to maintain the dental floss therebetween so that a user may readily access the dental floss as desired.

A plurality of protective wrappers are conveniently removably positioned about select sections of the toothbrush for maintaining same in a substantially sanitary condition during non-use conditions. A first one of the plurality of wrappers is preferably disposed about the brushing section and a second one of the plurality of wrappers is preferably disposed about the accessory dispensing section. The first and second wrappers each may include a removable tab member for advantageously allowing a user to readily access the toothbrush. A third one of the plurality of wrappers is preferably disposed about the elongated shaft for protecting the gripping portion from the environment during non-use conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
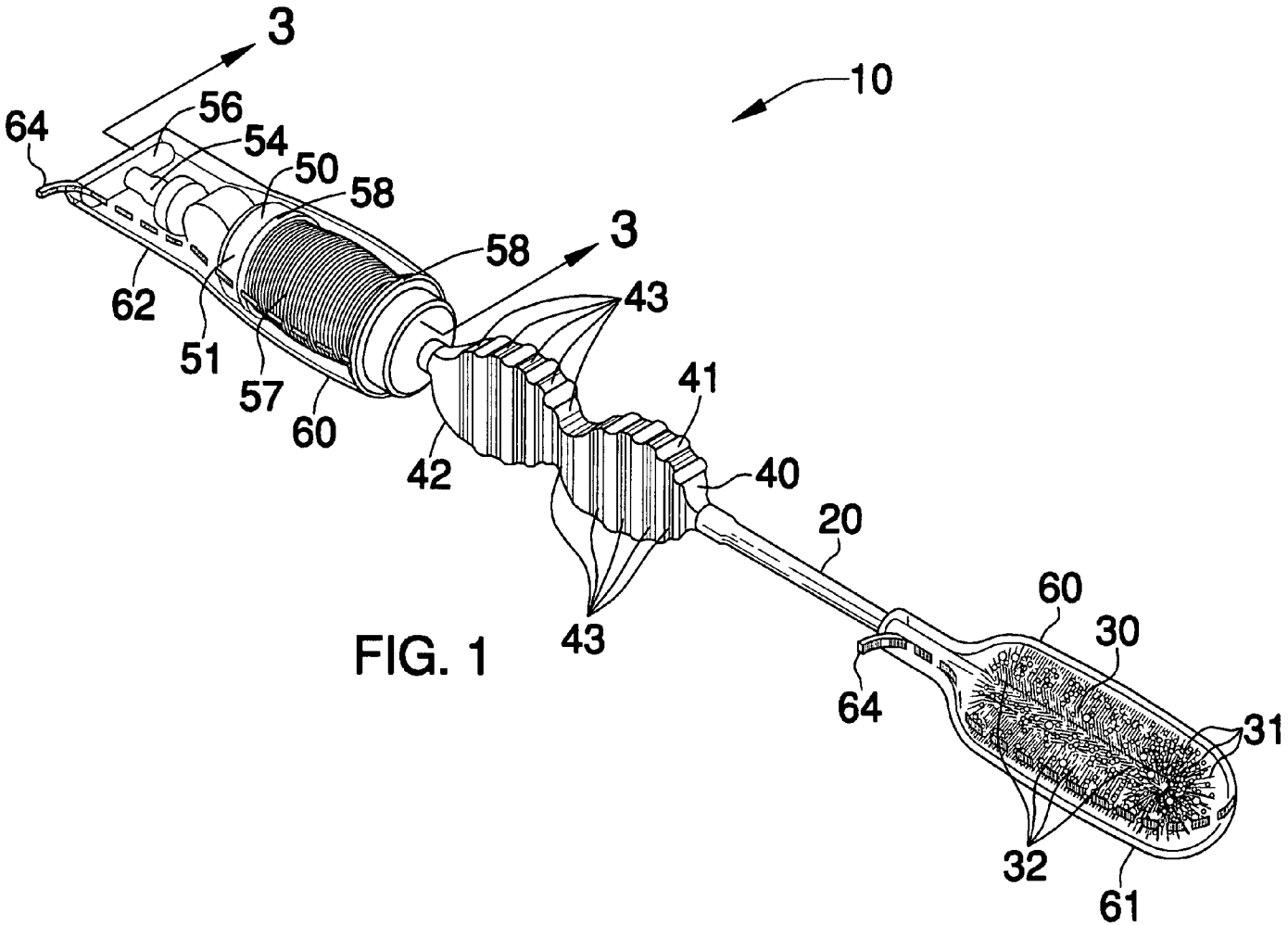
FIG. 1 is a perspective view showing a disposable oral care device, in accordance with the present invention.
Figure 2:
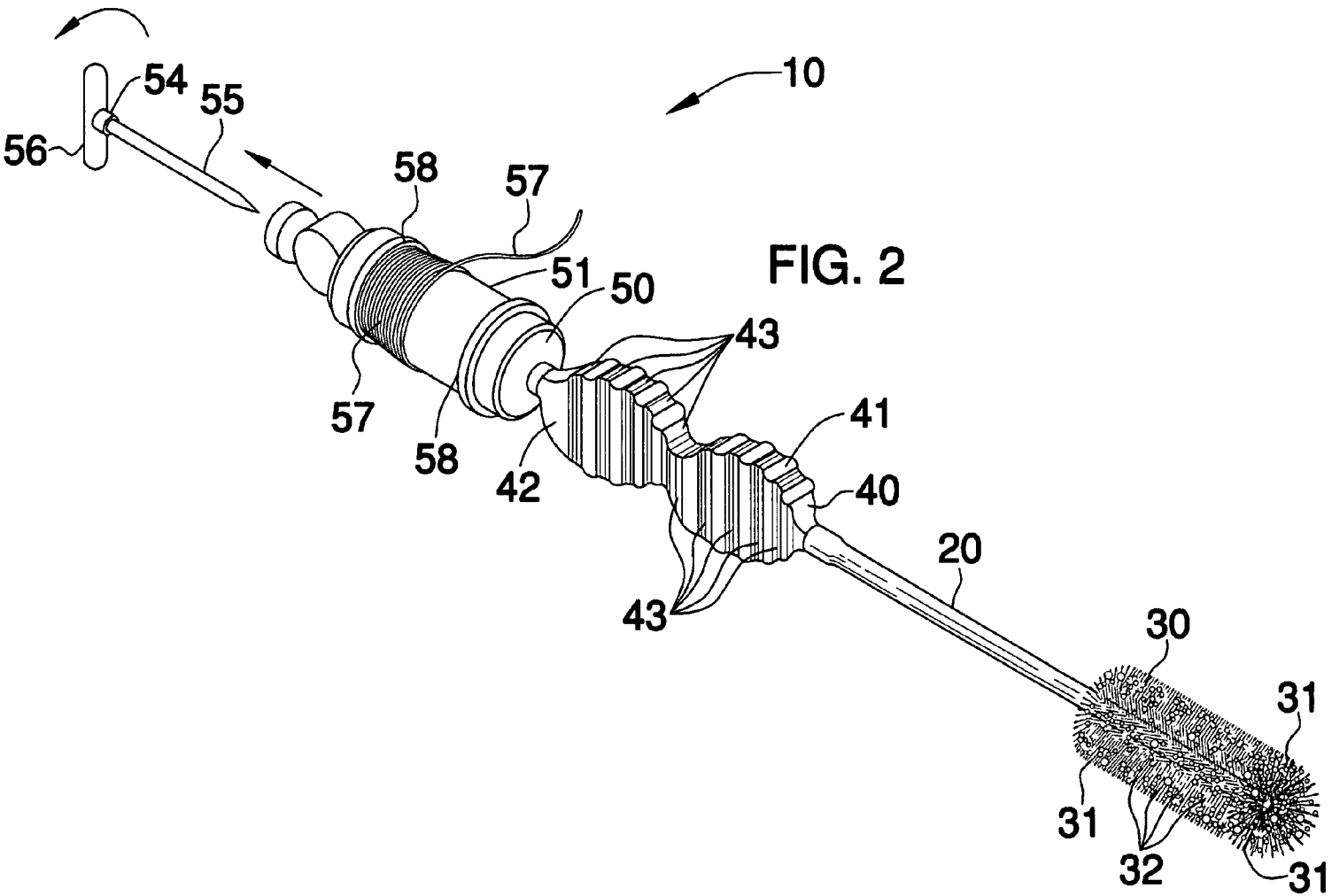
FIG. 2 is a partially exploded view of the device shown in FIG. 1.
Figure 3:
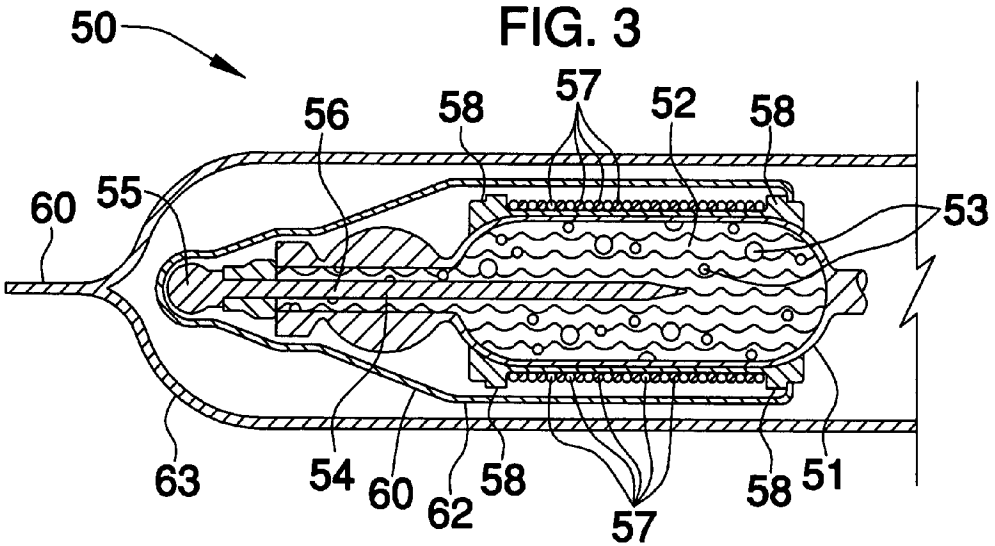
FIG. 3 is an enlarged cross-sectional view of the device shown in FIG. 1 taken along line 3—3.
Figure 4:
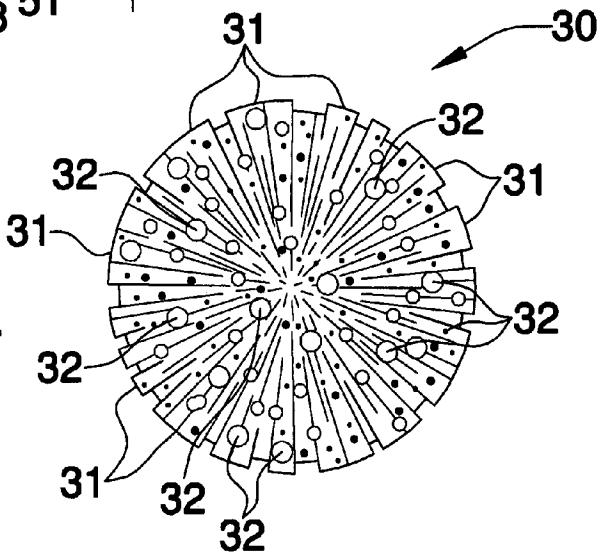
FIG. 4 is an enlarged front-end view of the device shown in FIG. 1.
Figure 5:
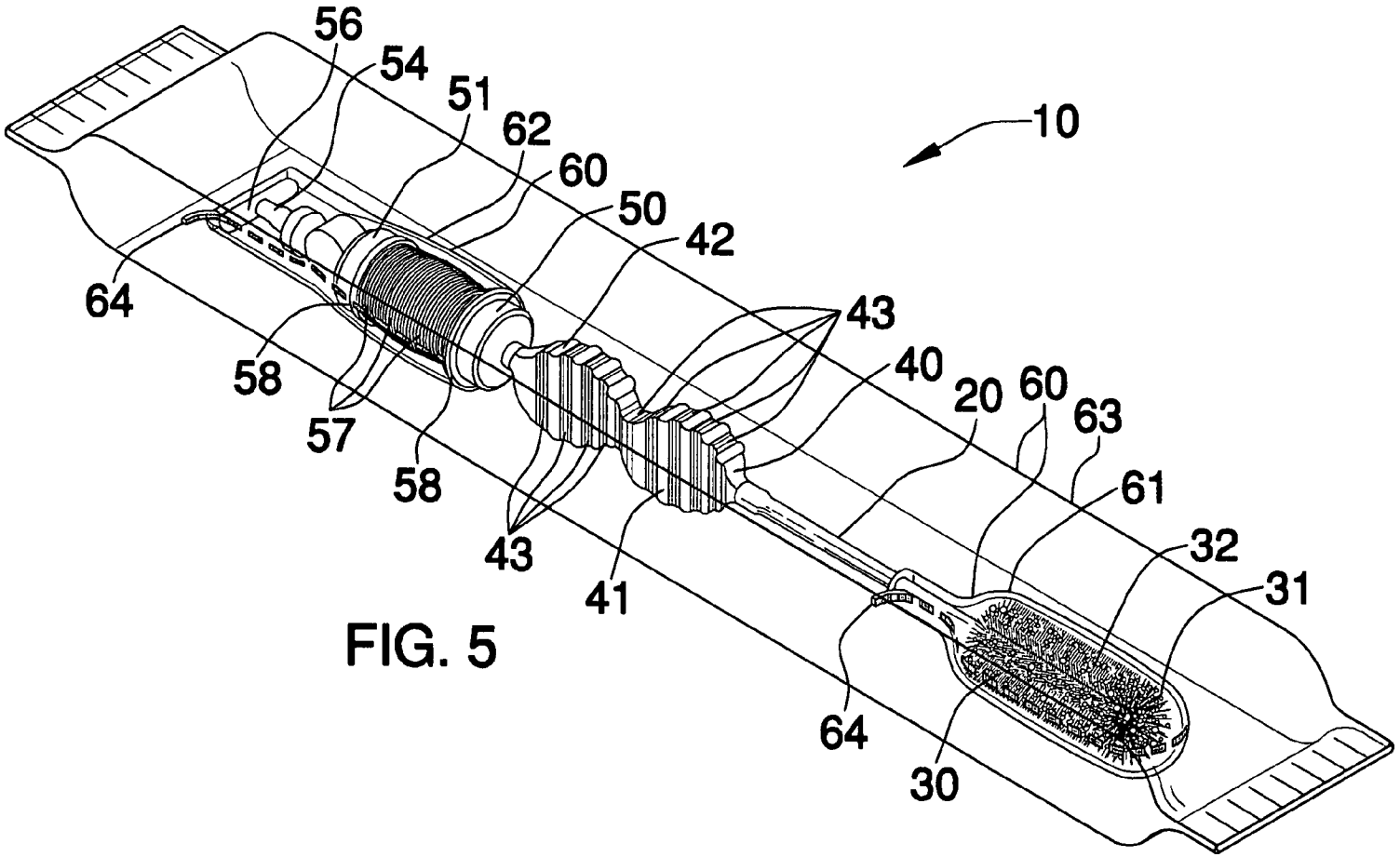
FIG. 5 is a perspective view showing the present invention packaged inside a plurality of wrappers.

The present invention will now be described more fully hereinafter with reference to the accompanying drawings, in which a preferred embodiment of the invention is shown.

This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1–5 by the reference numeral 10 and is intended to provide a disposable oral care device. It should be understood that the device 10 may be employed by residential, commercial and government users.

Referring initially to FIG. 1, the device 10 includes an elongated shaft 20 including a brushing section 30 that has a plurality of bristles 31 extending radially outwardly from the shaft 20.

The plurality of bristles 31 have a unique size suitable for its intended application, and a predetermined quantity of a tooth-cleaning agent 32 advantageously coated onto the plurality of bristles 31 wherein the agent 32 is activatable via water. Of course, the brushing section 30 can be formed in various shape and sizes ranging from approximately half the size of a conventional toothbrush to twice the size of a conventional toothbrush. The plurality of bristles 31 may be formed o have various rigidity such as soft, medium and hard to accommodate individual user preferences due to gum sensitivity.

The shaft 20 further includes a gripping section 40 integral with the brushing section 30 and spaced generally medially of the shaft 20. The gripping section includes top 41 and bottom 42 surfaces extending outwardly from the shaft 20 and has a plurality of grooves 43 formed therein for assisting a user to conveniently maintain a secure grip of the toothbrush 10. The gripping section 40 can conveniently be constructed in varying sizes such that the device 10 can be used by adults and young children alike.

The shaft 20 further includes an accessory dispensing section 50 integral with the gripping section 40 and oppositely spaced from the brushing section 30. The accessory dispensing section 50 includes a reservoir 51 that has a generally cylindrical body defining a cavity 52 therein, and a predetermined quantity of mouthwash 53 advantageously disposed within the reservoir 51. The reservoir 51 includes a detachable bottom end portion 54 for conveniently allowing the mouthwash 53 to be dispensed from the cavity 52. The bottom end portion 54 includes an elongated shaft portion 55 and a handle portion 56 integral therewith wherein the shaft portion 55 is removable from the cavity 52 when the handle portion 56 is twisted outwardly and away from the reservoir 51. Advantageously, the end portion 54 has a sharpened tip so that a user may conveniently employ same as a toothpick. Of course, the end portion 54 may be selectively inserted into the reservoir 51 during non-use conditions.

The accessory dispensing section 50 further includes a predetermined quantity of dental floss 57 wrapped about the reservoir 51. The reservoir 51 includes a plurality of spaced lip portions 58 extending radially outwardly therefrom for assisting to maintain the dental floss 57 therebetween so that a user may readily access the dental floss 57 as desired. The compact nature of the accessory dispensing section and all the accessories it accommodates greatly reduces the amount of packing space needed that might other wise have been consumed by conventional accessories.

A plurality of protective wrappers 60 are conveniently removably positioned about select sections of the toothbrush 10 for maintaining same in a substantially sanitary condition during non-use conditions. A first one 61 of the plurality of wrappers 60 is disposed about the brushing section 30 and a second one 62 of the plurality of wrappers is disposed about the accessory dispensing section 50. The first 61 and second 62 wrappers 60 each include a removable tab member 64 for advantageously allowing a user to readily access the toothbrush 10. A third one 63 of the plurality of wrappers 60 is disposed about the elongated shaft 20 for protecting the gripping portion 40 from the environment during non-use conditions.

Such a plurality of wrappers 60 will prevent any harmful chemicals from getting onto the bristles 31, such as spilled shampoo. It also prevents any human contamination in the event of a spot baggage check that so often occurs at airports.

The appealing features of the device 10 are its convenience, four-in-one design, portability, practicality and inexpensiveness. The presence of tooth-cleaning agent 32, mouthwash 53, and dental floss 57 allows for the complete oral hygiene regiment that is currently prescribed by most dentists. The device 10 is versatile enough to be used during all kinds of travel, whether it is a business or a hiking trip. This device 10 will reduce the chances of forgetting to pack oral hygiene products and would ultimately take up less space in a suitcase or overnight bag.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multi-purpose toothbrush for promoting oral hygiene and comprising:

an elongated shaft comprising a brushing section comprising a plurality of bristles extending radially outwardly from said shaft, said plurality of bristles having a unique size suitable for its intended application, and a predetermined quantity of a tooth-cleaning agent coated onto said plurality of bristles wherein said agent is activatable via water;

said shaft further comprising a gripping section integral with said brushing section and spaced generally medially of said shaft, said gripping section comprising top and bottom surfaces extending outwardly from said shaft and having a plurality of grooves formed therein for assisting a user to maintain a secure grip of said toothbrush;

said shaft further comprising an accessory dispensing section integral with said gripping section and oppositely spaced from said brushing section; and a plurality of protective wrappers removably positioned about select sections of said toothbrush and for maintaining same in a substantially sanitary condition during non-use conditions.

2. The multi-purpose toothbrush of claim 1, wherein said accessory dispensing section comprises:

a reservoir having a generally cylindrical body and defining a cavity therein; and a predetermined quantity of mouthwash disposed within said reservoir.

3. The multi-purpose toothbrush of claim 2, wherein said accessory dispensing section further comprises:

a predetermined quantity of dental floss wrapped about said reservoir, said reservoir including a plurality of spaced lip portions extending radially outwardly therefrom and for assisting to maintain said dental floss therebetween so that a user may readily access said dental floss as desired.

4. The multi-purpose toothbrush of claim 3, wherein said reservoir comprises:

a detachable bottom end portion for allowing said mouthwash to be dispensed from the cavity, said bottom end portion including an elongated shaft portion and a handle portion integral therewith wherein said shaft portion is removable from the cavity when said handle portion is twisted outwardly and away from said reservoir.

5. The multi-purpose toothbrush of claim 1, wherein a first one of said plurality of wrappers is disposed about said brushing section and a second one of said plurality of wrappers is disposed about said accessory dispensing section, said first and second wrappers each include a removable tab member for allowing a user to readily access said toothbrush.

6. The multi-purpose toothbrush of claim 1, wherein a third one of said plurality of wrappers is disposed about said elongated shaft for protecting said gripping portion from the environment during non-use conditions.

7. A multi-purpose toothbrush for promoting oral hygiene and comprising:

an elongated shaft comprising a brushing section comprising a plurality of bristles extending radially outwardly from said shaft, said plurality of bristles having a unique size suitable for its intended application, and a predetermined quantity of a tooth-cleaning agent coated onto said plurality of bristles wherein said agent is activatable via water;

said shaft further comprising a gripping section integral with said brushing section and spaced generally medially of said shaft, said gripping section comprising top and bottom surfaces extending outwardly from said shaft and having a plurality of grooves formed therein for assisting a user to maintain a secure grip of said toothbrush;

said shaft further comprising an accessory dispensing section integral with said gripping section and oppositely spaced from said brushing section, said accessory dispensing section comprising a reservoir having a generally cylindrical body and defining a cavity therein, and a predetermined quantity of mouthwash disposed within said reservoir; and a plurality of protective wrappers removably positioned about select sections of said toothbrush and for maintaining same in a substantially sanitary condition during non-use conditions.

8. The multi-purpose toothbrush of claim 7, wherein said accessory dispensing section further comprises:

a predetermined quantity of dental floss wrapped about said reservoir, said reservoir including a plurality of spaced lip portions extending radially outwardly therefrom and for assisting to maintain said dental floss therebetween so that a user may readily access said dental floss as desired.

9. The multi-purpose toothbrush of claim 8, wherein said reservoir comprises:

a detachable bottom end portion for allowing said mouthwash to be dispensed from the cavity, said bottom end portion including an elongated shaft portion and a handle portion integral therewith wherein said shaft portion is removable from the cavity when said handle portion is twisted outwardly and away from said reservoir.

10. The multi-purpose toothbrush of claim 7, wherein a first one of said plurality of wrappers is disposed about said brushing section and a second one of said plurality of wrappers is disposed about said accessory dispensing section, said first and second wrappers each include a removable tab member for allowing a user to readily access said toothbrush.

11. The multi-purpose toothbrush of claim 7, wherein a third one of said plurality of wrappers is disposed about said elongated shaft for protecting said gripping portion from the environment during non-use conditions.

12. A multi-purpose toothbrush for promoting oral hygiene and comprising:

an elongated shaft comprising a brushing section comprising a plurality of bristles extending radially outwardly from said shaft, said plurality of bristles having a unique size suitable for its intended application, and a predetermined quantity of a tooth-cleaning agent coated onto said plurality of bristles wherein said agent is activatable via water;

said shaft further comprising a gripping section integral with said brushing section and spaced generally medially of said shaft, said gripping section comprising top and bottom surfaces extending outwardly from said shaft and having a plurality of grooves formed therein for assisting a user to maintain a secure grip of said toothbrush;

said shaft further comprising an accessory dispensing section integral with said gripping section and oppositely spaced from said brushing section, said accessory dispensing section comprising a reservoir having a generally cylindrical body and defining a cavity therein, a predetermined quantity of mouthwash disposed within said reservoir, and a predetermined quantity of dental floss wrapped about said reservoir, said reservoir including a plurality of spaced lip portions extending radially outwardly therefrom and for assisting to maintain said dental floss therebetween so that a user may readily access said dental floss as desired; and a plurality of protective wrappers removably positioned about select sections of said toothbrush and for maintaining same in a substantially sanitary condition during non-use conditions.

13. The multi-purpose toothbrush of claim 12, wherein said reservoir comprises:

a detachable bottom end portion for allowing said mouthwash to be dispensed from the cavity, said bottom end portion including an elongated shaft portion and a handle portion integral therewith wherein said shaft portion is removable from the cavity when said handle portion is twisted outwardly and away from said reservoir.

14. The multi-purpose toothbrush of claim 12, wherein a first one of said plurality of wrappers is disposed about said brushing section and a second one of said plurality of wrappers is disposed about said accessory dispensing section, said first and second wrappers each include a removable tab member for allowing a user to readily access said toothbrush.

15. The multi-purpose toothbrush of claim 12, wherein a third one of said plurality of wrappers is disposed about said elongated shaft for protecting said gripping portion from the environment during non-use conditions.

* * * * *